United States Patent [19]

Tao

[11] Patent Number: 4,476,078

[45] Date of Patent: Oct. 9, 1984

[54] PROCESS FOR MANUFACTURING EMBOSSED NONWOVEN FIBROUS PRODUCTS

[75] Inventor: Thomas M. Tao, Neenah, Wis.

[73] Assignee: James River-Dixie/Northern, Inc., Norwalk, Conn.

[21] Appl. No.: 374,700

[22] Filed: May 4, 1982

[51] Int. Cl.[3] ..... D04N 1/64

[52] U.S. Cl. ..... 264/119; 264/128

[58] Field of Search ..... 264/119, 128

[56] References Cited

U.S. PATENT DOCUMENTS

| | | | |
|---|---|---|---|
| 2,811,769 | 11/1957 | Craig | 264/128 |
| 3,150,416 | 9/1964 | Such | 264/128 |
| 4,315,965 | 2/1982 | Mason et al. | 264/119 |
| 4,377,543 | 3/1983 | Strohbeen et al. | 264/128 |

*Primary Examiner*—James R. Hall

*Attorney, Agent, or Firm*—Finnegan, Henderson, Farabow, Garrett & Dunner

[57] ABSTRACT

A process for manufacturing embossed, nonwoven fibrous products comprising the steps of subjecting a binder-treated fibrous dry laid web to a low cure treatment to obtain a moldable web with good physical integrity; embossing the low cure treated web; and fully curing the web.

16 Claims, 2 Drawing Figures

PROCESS FOR MANUFACTURING EMBOSSED NONWOVEN FIBROUS PRODUCTS

BACKGROUND OF THE INVENTION

The present invention is directed to an improved process for manufacturing embossed nonwoven fibrous products.

Embossing treatment adds aesthetic and performance attributes to many paper and fibrous products. Embossing has been practiced both in the paper product and nonwoven fibrous product fields. In the field of air laid nonwoven fibrous products, however, high speed embossing presents unique problems.

Air laid nonwoven webs can be differentiated from "paper" products because air laid nonwoven webs do not possess hydrogen bonding for needed product strength. Instead, air laid nonwoven webs are bonded by latexes, starches, or thermoplastic binders. U.S. Pat. No. 3,575,749 to Kroyer discloses methods for making fibrous sheets or webs.

The Kroyer patent teaches as part of the Background of the Invention that paper-like sheets or webs can be made by forming, on an endless metal band, a binder film and supplying to the binder film cellulosic fibers which form a uniform fiber layer on the binder film by means of an electrostatic field.

The Kroyer patent discloses another method for forming cellulosic fiber sheets or webs in which the fibers are deposited upon a forming surface which may be a foraminous metal band or other type of gas permeable band such as a porous scrim. A stream of gas containing suspended fibers is passed through the forming surface to form a fiber layer thereon. The fibers of the fiber layer are bonded together by applying a binder. The method of Kroyer thus produces a continuous sheet of fibrous material.

Air laid nonwoven webs, including those taught by Kroyer, are sometimes subjected to an embossing step to add aesthetic and performance attributes to the finished product.

The existing embossing techniques for air laid nonwoven fibrous materials fall into two general categories. The embossing step may be carried out prior to the binder application, which is commonly referred to as "pre-embossing." The second method is to carry out an embossing step after the binder material is applied, dried and set. This method is known as "post-embossing."

The "pre-embossing" technique is disclosed in U.S. Pat. No. 4,135,024 to Callahan et al. In a pre-embossing method, an air laid nonwoven web is subjected to embossing by concurrently passing it through a nip formed by an embossing roll and an anvil roll prior to applying any binder to the web. The web at this stage, not being binder treated nor cured, is weakly bonded. The weakness of the web prohibits embossing of the web at reasonable production speeds. The weak web causes special handling problems which can only be remedied by special requirements such as web carrier, web reenforcements, or long fiber addition which cause loss of production speed and increased cost. Further, the embossed substrates suffer a permeability loss, which in turn, decreases the drying efficiency since more energy is required for drying. In the subsequent binder application, the embossed fibers tend to relax and cause a reduction in embossing definition and clarity because the relaxed fibers tend to "spring back."

The "post-embossing" technique subjects the web to an embossing step after it is treated with a bonding agent and dried and cured. The post-embossing method eliminates web handling difficulty, as well as spring-back and drying problems. Production speed can be increased because of the increased strength of the strongly bonded web. This method, however, is unsatisfactory because good embossing definition and high embossing quality cannot be achieved. The binder treated web, once dried and set, becomes resilient to pressure and deformation enabling the web to resist embossing.

SUMMARY OF THE INVENTION

It is therefore an object of the present invention to overcome the aforementioned disadvantages of the previous techniques of producing embossed air laid nonwoven fibrous products.

Additional objects and advantages of the invention will be set forth in part in the description which follows and in part will be obvious from the description, or may be learned by practice of the invention. The objects and advantages of the invention are realized and obtained by means of the processes, materials and the combinations particularly pointed out in the appended claims.

The invention provides a process capable of manufacturing embossed air laid nonwoven fibrous webs at high speeds and providing good embossing definition in the product. The invention includes the steps of applying a cross-linkable binder to a fibrous air laid nonwoven web; partially curing the binder to provide a partially cured and moldable web that maintains physical integrity during transport to and from an embossing zone, and during embossing; embossing the partially cured web; and fully curing the embossed web.

The binder is usually partially cured to a percent cure of from 15–90%, and preferably from 55–80% prior to embossing.

Preferably, the binder is an aqueous system containing a cross-linking agent, and is applied to the web by spraying, and heat is applied to the web during the partial curing step and the fully curing step.

In a preferred embodiment, the invention includes the steps of applying in a first application zone a cross-linkable binder to one side of a fibrous air laid nonwoven web; partially curing the binder in a first partial curing zone to provide a partial cure which results in a web that maintains physical integrity during transport through a second binder application zone; applying in a second binder application zone a cross-linkable binder to the other side of said air laid nonwoven web; partially curing in a second partial curing zone the binder in said web after passage from the second binder application zone to provide a moldable web having a 15–90% cure; embossing the partially cured web after passage of said web from the second partial curing zone; and fully curing the embossed web.

DETAILED DESCRIPTION OF PREFERRED EMBODIMENTS OF THE INVENTION

Reference will now be made in detail to present preferred embodiments of the invention, examples of which are illustrated in the accompanying drawings.

Figure 1:
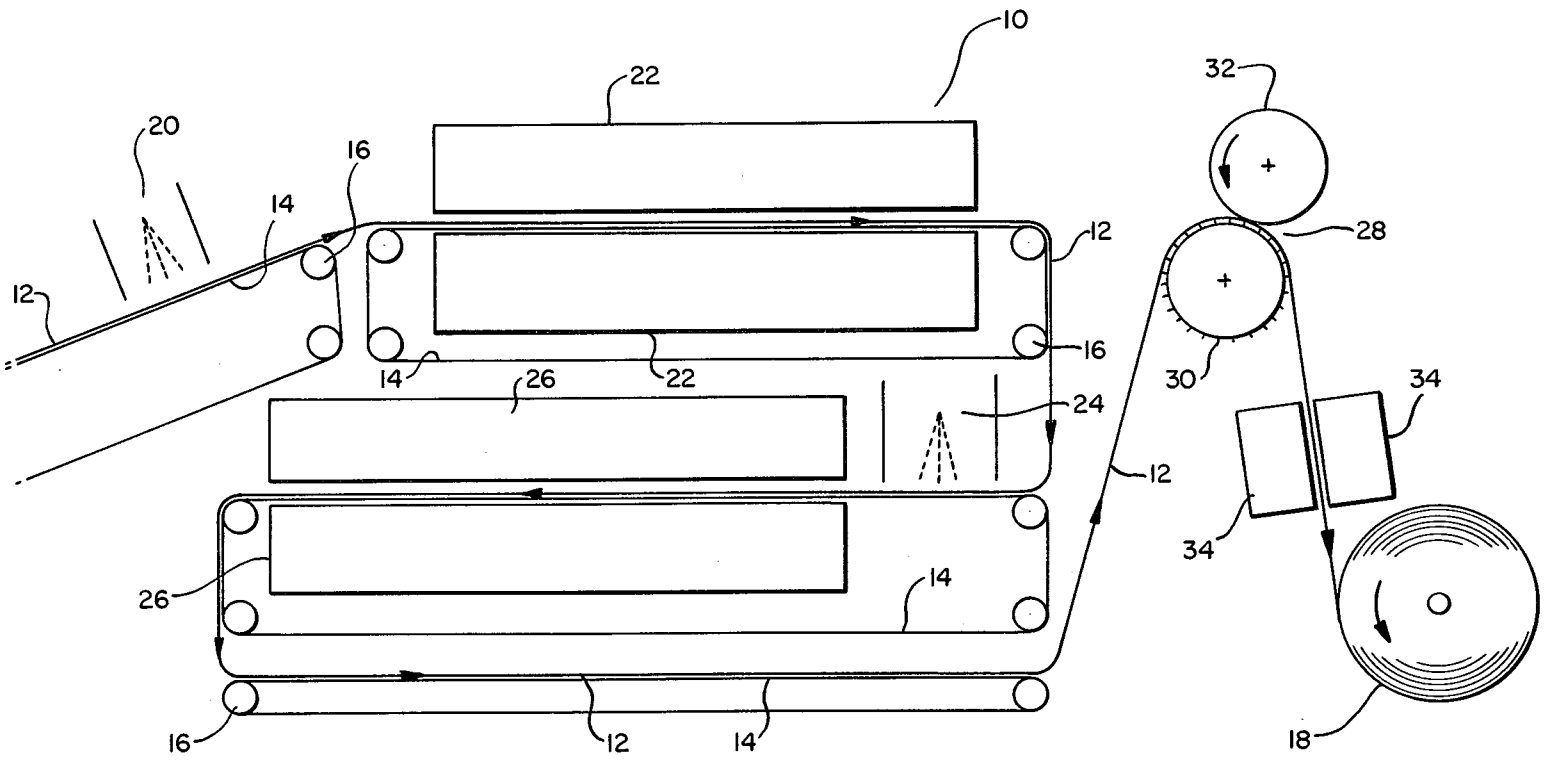
FIG. 1 is a schematic view of a preferred embodiment of apparatus according to the invention.

A preferred embodiment of an apparatus of the invention for manufacturing embossed nonwoven fibrous products is represented generally in FIG. 1 by the numeral 10. The nonwoven fibrous web 12, as it is being formed, is advanced by means which includes endless belts 14, 14A, 14B, and 14C driven by pulleys 16, as known in the art.

One side of the web is initially treated with a binder by spray application at a first application zone 20. The sprayed web moves through a first through air dryer 22. The web then moves through a second application zone 24 where the opposite side of the web is then binder sprayed. The web then moves to an embossing station noted generally as 28 where the web passes between a nip formed by an embossing roll 30 and an anvil roll 32. The embossed web then passes through a curing dryer 34. The cured web is collected and rolled at the parent roll 18.

Binder can be applied to the air laid nonwoven web by a variety of contact and noncontact techniques, with noncontact techniques, such as spraying, preferred.

The web 12 is formed from cellulosic fibers or a mixture of cellulosic and synthetic fibers as is well-known in the art. The cross-linkable binder zones may be any selected from cross-linkable binders known in the art for treating fibrous webs.

The cross-linkable binder is preferably an aqueous system such as a latex emulsion that incorporates a cross-linking agent. Exemplary of such systems are vinylacetate ethylene, N methylolacrylamide (NMA) terpolymers, vinylacetate ethylene-X terpolymers, styrene-butadiene rubber latexes (SBR-X), vinylacrylate-X, acrylic-X, vinyl acetate-X homopolymer and ethylene vinylchloride-X, where X denotes a cross-linking agent.

Suitable cross-linking agents include: N-methylolacrylamide (NMA); carboxylated styrene butadiene latexes (SBR); substituted aziridine ring opening followed by cross-linking; melamine formaldehyde (cymel products); siloxane cross-linkers; urea formaldehydes, and any other heat or electromagnetic radiation activated agent resulting in the development of covalent bonds resulting in loss of thermoplasticity and increasing the wet strength of the binder.

The binder applied at the spraying station is selected to provide sufficient solids concentration so that the partially cured web can be transported at high speeds and advantageously embossed. The amount of binder solids applied depends upon the end product desired and the type of binder used. The add-on weight range for applying the binder is, generally, but not limited to, 5–35% add-on. Add-on being defined as the percent weight of binder solids to the total weight of the dried binder treated web.

The first through air dryer 22 should be held at a temperature so that the percent cure of the web after passing through is in the range of 15–90%. The percent cure of the web 12 after it passes through the second through air dryer 26 after being binder sprayed at binder station 24 should be in the range of 15–90%. It is preferred that the percent cure of the web after passing through the first and second through air dryer be in the range of 55–80%.

In order to achieve the range of percent cure of the web of 15–90%, the moisture content of the web (if a water-based binder is used) should, generally, be not less than 1%. To achieve this end the temperature of the through air dryer should, generally, be less than 410° F. To achieve the preferred percent cure range of 55–80% for the web the exit moisture of the web should, generally, be in the range of 2 to 7% after passing through the second through air dryer. In order to achieve the preferred percent cure range the temperature of the second through air dryer should be, generally, in the range of 225° to 375° F. It is apparent, of course, that longer exposure of the web in a cooler through air dryer or shorter exposure of the web in a hotter through air dryer may be used to achieve the critical ranges of percent cure for the web.

The web with percent cure of 15–90% and an exit moisture greater than 1% is relatively dry, but has some residual moisture and is warm. The binding agent is dry but it has not been set at this point so that the web is somewhat "moldable," that is the web can be deformed by embossing and will retain its deformed shape after embossing and final curing. The web strength at this point, while not at its peak, is substantial. The binder treated web having a percent cure in the range of 15–90% and preferably 55–80% is then in a desirable state to be embossed. The web is then advanced through the embossing station 28 by passing the web 12 through a nip formed by the embossing roll 30 and the anvil roll 32. The partially cured binder treated, embossed web is then passed through a cure dryer 34 for final curing. The cure dryer should be at a sufficient temperature to substantially dry the web and to set the binder in the embossed web, generally, about 400° F. In following the above-described process, it was found that the low moisture content, partially cured web had sufficient integrity to be handled at high speeds and minimized material waste.

Figure 2:
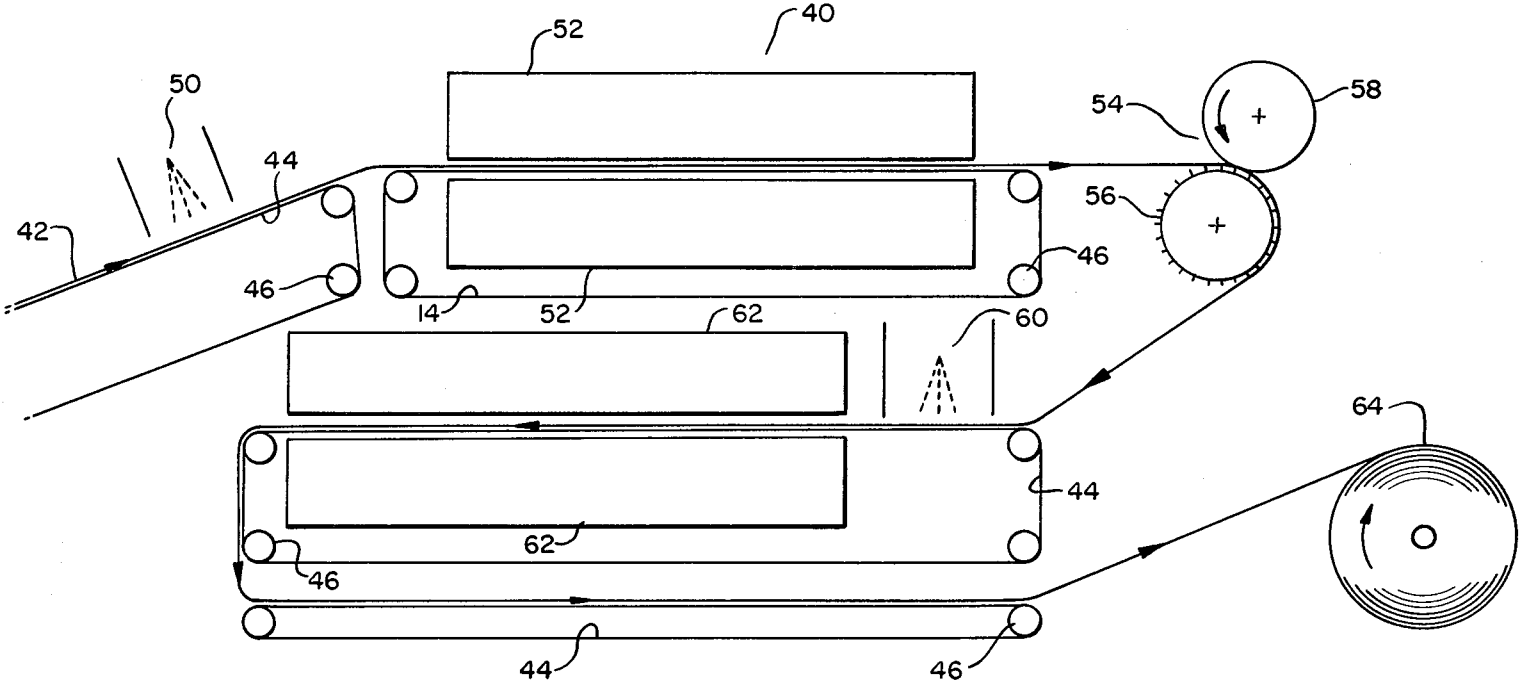
FIG. 2 is a schematic view of another preferred embodiment of apparatus according to the invention.

Another preferred embodiment of an apparatus for carrying out the invention for manufacturing embossed nonwoven fibrous products is represented, generally, in FIG. 2, by the numeral 40. The nonwoven fibrous web 42, as it is being formed, is advanced by means which include endless belts 44, 44A, 44B, and 44C driven by pulleys 46, as known in the art.

One side of the web is initally binder treated by spray application of a binder at a first spraying station 50. The sprayed web moves through a through air dryer 52. The web 42 is then advanced through a nip formed by an embossing roll 56 and an anvil roll 58. The embossed web is advanced to a second binder spraying station 60, where the opposite side of the web is binder sprayed. The binder sprayed web is then advanced through a cure dryer 62. The cured web moves beyond the cure dryer to be collected at the parent roll 64.

The process practiced by the apparatus of FIG. 2 can use the same binder and web materials as described for the process of FIG. 1.

The through air dryer 52 should be of a temperature so that the percent cure of the web after passing through is in the range of 15–90%, preferably in the range of 55–80%. In order to achieve the range of percent cure of the web of 15–90%, the moisture content of the web (if a water-based binder is used) should, generally, be not less than 1%. To achieve this end the temperature of the through air dryer 52 should, generally, be less than 410° F. To achieve the preferred percent cure range of 55–80% for the web the exit moisture of the web should, generally, be in the range of 2 to 7% after passing through the through air dryer 52. In order to achieve the preferred percent cure and exit moisture range, the temperature of the dryer 52 should be, generally, in the range of from 225° to 375° F. It is apparent that longer exposure of the web in a cooler through air dryer 52 or shorter exposure of the web in a hotter through air dryer 52 may be used to achieve the critical ranges of percent cure for the web.

The web with a percent cure of 15–90% and an exit moisture greater than 1% is relatively dry, but has some residual moisture and is warm. The binding agent is dry but it has not been set at this point so that the web is moldable. The web strength at this point, while not at its peak, is substantial. The binder treated web having a percent cure in the range of 15–90% and preferably 55–80% is then in a desirable state to be embossed. The web at this point is then advanced through the embossing station 54 by passing the web 42 through a nip formed by the embossing roll 56 and the anvil roll 58.

The partially cured binder treated embossed web is then advanced to a second spraying station 60, where the opposite side of the web is binder treated. The binder treated web is then passed through a cure dryer 62 for final curing. The cure dryer 62 should be at a sufficient temperature to substantially dry the web and to set the binder in the embossed web, generally, about 400° F. In following the above-described process, it was found that the partially cured web had sufficient integrity to be handled at high speeds and minimized material waste.

A variety of conventional web curing techniques can be used to partially cure and fully cure the web. Application of heat, preferably by a through air dryer, is a particularly convenient technique for the partial curing and full curing of the web according to the present invention.

The through air dryers 22 and 52 serve to condition the web moisture and latex percent cure to a state that is desirable for embossing treatment. The binder-treated web not being set and being in a moldable state does not require any preheating or premoisturizing before being subject to embossing.

Embossing the low cured web while it was still in a moldable state requires lower pressure, yet produces excellent emboss definition with a minimum of "springback" in the embossed sections. The degree of emboss definition depends upon the percent of cure of the web as it approaches the embossed roll. Webs highly cured prior to embossing are, generally, embossed with less resultant definition. Embossing the fibrous web according to the invention may be done in a wide range of known ways by varying the type of embossing rolls and embossing pressures used. These varieties include a light emboss that produces a shallow pattern or a heavier emboss that produces deeper patterns, or a full emboss or compacting which is essentially to pass the web through a nip formed by two flat surfaced anvil rolls to depress and compact the entire surface of the web.

The cure dryer 34 and 62 is energy efficient since no significant water removal is required and heat recycle practice can be applied beneficially.

The above-described process has been found to be latex efficient, the web maintaining a proper tensile strength at low cure without requiring additional amounts of latex binder.

The embossed nonwoven fibrous product produced according to the above described process has no springback deficiencies and has an attractive appearance.

Percent cure, as used in the specification and claims, means wet tensile strength of a partially cured section of web containing a given amount of binder solids divided by the wet tensile strength of an adjacent section of web that has been fully cured and contains the same amount of the same binder, multiplied by 100. The wet tensile strength of relatively absorbent tissue type products is defined as the tensile strength retained after the specimen has been wet for 15 to 30 seconds. The percent cure of products described in the invention is calculated using wet tensile strength data obtained from adjacent portions of the web products according to the official standard tests for determining wet tensile breaking strength of paper and paperboard of the Technical Association of Pulp and Paper Industry (TAPPI), such tests are designated as T456 os-68 and T494 os-70.

It will be apparent to those skilled in the art that various modifications and variations can be made to the process according to the present invention and in the designing and construction of the apparatus 10 and 40 without departing from the scope or spirit of the invention. As an example, the web may be retreated with binder on the same side of the web as has been previously binder treated, by additional binder spraying stations either prior to embossing or after embossing, to produce a binder-treated fibrous dry laid web that is advantageously embossed in a low-cured and moldable state and cured according to the invention. Thus, it is intended that the present invention cover the modifications and variations of this invention provided they come within the scope of the appended claims and their equivalents.

What is claimed is:

1. A process for manufacturing embossed air laid nonwoven fibrous webs comprising the steps of:

(a) applying a cross-linkable binder to a fibrous air laid nonwoven web;

(b) partially curing the binder to provide a partially cured and moldable web that maintains physical integrity during transport to an embossing zone, and during embossing;

(c) embossing the partially cured web; and (d) fully curing the embossed web.

2. The process of claim 1 in which the binder is partially cured to a percent cure of from 15–90%.

3. The process of claim 1 in which the binder is partially cured to a percent cure of from 55–80%.

4. The process of claim 3 in which the binder is an aqueous system containing a cross-linking agent.

5. The process of claim 4 in which the binder is applied to the web by spraying.

6. The process of claims 4 or 5 in which heat is applied to the web during the partial curing step and the fully curing step.

7. A process for manufacturing embossed air laid nonwoven fibrous webs comprising the steps of:

(a) applying in a first application zone a cross-linkable binder to one side of a fibrous air laid nonwoven web;

(b) partially curing the binder in a first partial curing zone to provide a partial cure which results in a web that maintains physical integrity during transport through a second binder application zone;

(c) applying in a second binder application zone a cross-linkable binder to the other side of said air laid nonwoven web;

(d) partially curing in a second partial curing zone the binder in said web after passage from the second binder application zone to provide a moldable web having a 15–90% cure;

(e) embossing the partially cured web after passage of said web from the second partial curing zone; and (f) fully curing the embossed web.

8. The process of claim 7 in which the binder is partially cured by passage through the second partial curing zone to a percent cure of 55–80%.

9. The process of claim 8 in which the binder is an aqueous system containing a cross-linking agent.

10. The process of claim 9 in which the binder is applied to the web by spraying.

11. The process of claims 8 or 9 in which heat is applied to the web during the partial curing steps.

12. A process for manufacturing embossed air laid nonwoven fibrous webs comprising the steps of:

(a) applying in a first application zone a cross-linkable binder to one side of a fibrous air laid nonwoven web;

(b) partially curing the binder in a partial curing zone to a 15–90% cure to produce a moldable web;

(c) embossing the moldable web;

(d) applying after the embossing step a binder to the other side of said fibrous air laid nonwoven web, and (e) fully curing the binder applied before and after the embossing step.

13. The process of claim 12 in which the binder is partially cured to a 55–80% cure.

14. The process of claim 13 in which the binder is an aqueous system containing a cross-linking agent.

15. The process of claim 13 in which the binder is applied to the web by spraying.

16. The process of claim 13 in which heat is applied to the web during the partial curing step.

* * * * *